US006997511B2

(12) United States Patent
Marchand et al.

(10) Patent No.: US 6,997,511 B2
(45) Date of Patent: Feb. 14, 2006

(54) SEATING DEVICE

(75) Inventors: Denis Marchand, McMasterville (CA); Lyne Noiseux, McMasterville (CA)

(73) Assignee: Transfert Plus, s.e.c., Montreal (CA)

( * ) Notice: Subject to any disclaimer, the term of this patent is extended or adjusted under 35 U.S.C. 154(b) by 0 days.

(21) Appl. No.: 10/820,723

(22) Filed: Apr. 9, 2004

(65) Prior Publication Data

US 2005/0225141 A1 Oct. 13, 2005

(51) Int. Cl.
*A47C 1/02* (2006.01)

(52) U.S. Cl. ..... 297/314; 297/313; 297/344.21; 297/344.19

(58) Field of Classification Search ..... 297/4, 297/195.11, 270.1, 314, 337, 338, 339, 344.19, 297/461, 462, 344.21, 313; 248/530, 521, 248/156, 371

See application file for complete search history.

(56) References Cited

U.S. PATENT DOCUMENTS

| | | | | |
|---|---|---|---|---|
| 163,287 | A | 5/1875 | Wheeler, Jr. et al. | |
| 1,161,604 | A * | 11/1915 | Bragg | 297/4 |
| 3,625,563 | A | 12/1971 | Dickinson et al. | |
| 4,130,263 | A | 12/1978 | Roericht | |
| 4,183,579 | A * | 1/1980 | Gonzalez y. Rojas | 297/195.11 |
| 4,653,808 | A | 3/1987 | Opsvik | |
| 4,738,487 | A | 4/1988 | Shalinsky et al. | |
| 4,930,839 | A | 6/1990 | Saito et al. | |
| 5,044,587 | A * | 9/1991 | Degen | 248/158 |
| D349,820 | S | 8/1994 | Schaevitz | |
| 5,390,979 | A | 2/1995 | Corlett | |
| 5,673,966 | A * | 10/1997 | Morton, Jr. | 297/4 |
| 5,720,522 | A | 2/1998 | Habeck | |
| 5,927,677 | A * | 7/1999 | Speece et al. | 248/516 |
| 6,033,016 | A * | 3/2000 | Haywood | 297/195.11 |
| 6,273,390 | B1 * | 8/2001 | Meyer | 248/507 |
| D467,745 | S | 12/2002 | Ryan | |
| 6,644,742 | B1 | 11/2003 | Walser | |
| 6,679,554 | B1 * | 1/2004 | Anders | 297/313 |
| 2003/0164633 | A1 | 9/2003 | Jakus et al. | |

* cited by examiner

*Primary Examiner*—Milton Nelson, Jr.
(74) *Attorney, Agent, or Firm*—Ogilvy Renault LLP

(57) ABSTRACT

A seating device comprising a connecting element having an end portion dimensioned to be releasably and rotatably inserted into an aperture defined in a ground or floor. The aperture is dimensioned to receive the connecting element so as to support the seating device. The seating device also comprises a supporting element connected to a seat. The supporting element is pivotably connected to the connecting element. Moreover, at least one of the connecting element and supporting element comprises at least one stop so as to permit the supporting element to pivot between a first position whereat the supporting element is in a substantially vertical position, and a second position whereat the supporting element is forwardly inclined of 30 degrees or less with respect to the first position. Such a device is particularly useful for persons who need to stabilize their posture while performing a task.

33 Claims, 10 Drawing Sheets

SEATING DEVICE

FIELD OF THE INVENTION

The present invention relates to improvements in the field of seating devices. More particularly, the invention relates to ergonomic seating devices.

BACKGROUND OF THE INVENTION

Several attempts have been made to provide ergonomic solutions for workers which have to perform tasks in both raised and seated positions. In fact, some tasks can hardly be performed while the worker is completely seated since they require a substantial mobility from the user. Thus, over long periods of work such tasks can be very tiring for workers. Some seating devices have been developed so as to provide these workers with a further point of support in addition to their legs so as to stabilize the posture of their body, without being in a completely seated position. By using these devices a worker can thus perform tasks in a raised position and in an intermediate position so-called a sit-stand position. Some of these devices are thus called sit-stand stools or seats.

Examples of these sit-stand stools are sold by the company Steelcase™ under the name B Free™. This stool comprises a base made of a flexible material which allows a user to incline the stool at various angled positions in various directions while performing a task. The stability of the stool is maintained by means of the grip of the flexible material to the floor.

U.S. Pat. No. 4,130,263 describes a stool having a stem connected to a sand-filed base. The base comprises a flexible bag filed with sand and this base can change of shape in response to displacement of the bag produced by a tilting of the stem. However, this stool can be substantially heavy for some users in view of the amount of sand required to maintain its stability. Such a base can also be bulky and cause obstruction to a user's feet particularly when the person is not using the stool.

U.S. Published Application No. 2003/0164633 describes a sitting device comprising a seat, a stem and a floor-contacting element which acts as a base. The base has a point of apex and an outside edge which permits a user to incline or tilt the stool at various angled positions in various directions.

Some workers are however reluctant to use any one of the above-mentioned stools since they can be tilted or inclined in any directions at various angled positions and it may be difficult for a user to stabilize them. The tilting of the stem can eventually generate a lost of stability and the user can even fall down. Moreover, the grip of the base member to the floor can be reduced by dust or other impurities and can cause the stool to skid, thereby exposing a user to potential injuries. Also, since these stools can be tilted in considerably inclined positions, their use in some small workspaces such as the cashier's workspace behind a check-out counter may not be appropriate.

It is well known for ergonomists that it is sometimes difficult to convince workers to perform tasks in a different manner than the way they have been doing these tasks for many years. It is also difficult to convince them to use new tools or devices to perform these tasks. It has been demonstrated over the years that new solutions such as new methods or devices presented as alternative solutions to workers must be simple, easy to use, safe and must offer considerable advantages over the known methods or devices in order to be adopted or used by the workers. There is therefore a need to provide a seating device which would be simple, safe, easy to use and which would overcome the above mentioned drawbacks.

SUMMARY OF THE INVENTION

It is therefore an object of the present invention to provide a seating device which overcomes the above drawbacks.

It is another object of the present invention to provide a seating device which is safe and easy to use and stabilize.

It is another object of the present invention to provide a seating device which provides a plurality of positions for a user.

It is another object of the invention to provide a seating device which permits a user to carry out tasks while sitting on it, without however considerably reducing his mobility.

It is another object of the invention to provide a seating device which is light, not bulky and easily stored.

According to one aspect of the invention, there is provided a seating device comprising:

- a connecting element having a end portion dimensioned to be releasably and rotatably inserted into an aperture defined in a ground or a floor, the aperture being dimensioned to receive the connecting element so as to support the seating device; and
- a supporting element connected to a seat, the supporting element being pivotably connected to the connecting element,
- at least one of the connecting element and supporting element comprises at least one stop so as to permit the supporting element to pivot between a first position whereat the supporting element is in a substantially vertical position, and a second position whereat the supporting element is forwardly inclined of 30 degrees or less with respect to the first position.

According to another aspect of the invention, there is provided a seating device comprising:

- a receiving element adapted to be fixed to a floor, the receiving element defining an internal bore;
- a connecting element having a end portion dimensioned to be releasably and rotatably inserted into the bore so as to support the seating device; and
- a supporting element connected to a seat, the supporting element being pivotably connected to the connecting element,
- at least one of the connecting element and supporting element comprises at least one stop so as to permit the supporting element to pivot between a first position whereat the supporting element is in a substantially vertical position, and a second position whereat the supporting element is forwardly inclined of 30 degrees or less with respect to the first position.

According to still another aspect of the invention, there is provided a seating device comprising:

- a seat; and
- a supporting element having
  - a first member connected to the seat, and
  - a second member having an end portion dimensioned to be releasably and rotatably inserted into a floor defining an aperture dimensioned to receive the one end portion so as to stabilize the second member within the aperture,
- the first and second member being pivotally connected together and the supporting element comprising at least one stop so that the first member is allowed to pivot between a first position whereat the first portion is in a substantially vertical position, and a second position whereat the first portion is forwardly inclined of 30 degrees or less with respect to the first position.

Applicants have found that by using any one of the seating devices as defined above, it is possible to provide a safe and efficient solution for persons who perform tasks in both raised and sited positions. These seating devices provide a safe support to persons who need to stabilize their posture without reducing their mobility. In fact, since these seating devices are prevented from being rearwardly inclined beyond a substantially vertical position, the risks for a user to loose stability or fall are thus reduced. Such devices permit to the user to have a good mobility since they can be rotated and forwardly inclined and allow the latter to perform various tasks while sitting on one of them. Moreover, since these seating devices are safely inserted and supported within the aperture or bore, tilting one of these devices will not cause lost of grip between the seating device and the surface or floor on which the device rests. In fact, the particular characteristics of the portion of the device inserted in the aperture, which acts as a "base", permits to avoid the drawbacks of the seating devices of the prior art concerning their limited grip to the surface on which they rest. The "base" of the seating devices of the invention is also non bulky thereby avoiding to generate obstruction to a user's feet. The seating devices of the invention provide a further point of support to a user and thus permit him to stabilize his posture and reduce the risks of premature fatigue or discomfort. The sit-stand position adopted by a user using one of the devices of the invention thus provides stability, mobility and comfort. By using any one of these seating devices, a user reduces the stress exerted on his legs and more particularly his knees, feet and ankles.

Applicants have also found that users generally feel safe when using the seating devices of the invention since tilting is limited between the first and second positions. In particular, the users trend to be more assured by using Applicants' devices since these devices cannot be rearwardly inclined beyond a substantially vertical position.

Applicants have also found that the seating devices of the present invention are particularly useful since they can be easily removed from the aperture and stored in a small area. When a user desires to use one of these devices, it can be easily inserted into an aperture or bore and when the user wants perform tasks without the device, it can be stored as example on a shelf of a counter. The device thus permits an easy handling and storing. Therefore, a user does not have to walk and carry the device over a considerable distance before using it or simply storing it.

According to yet another aspect of the present invention there is provided in a seating device comprising a seat, a tilting stem and a base, the improvement comprising the stem being pivotally connected to the base, and at least one of the stem and the base having at least one stop so as to permit the stem to pivot between a first position whereat the pivoting portion is in a substantially vertical position, and a second position whereat the pivoting portion is forwardly inclined of 30 degrees or less with respect to the first position.

According to a further aspect of the invention, there is provided in a seating device comprising a seat, a tilting stem and a base, the improvement comprising the base being dimensioned to be inserted in an aperture defined in a floor so that the base is rotatably and releasably inserted in the aperture so as to support the seating device, the base being dimensioned to avoid generating obstruction with a user's feet.

According to still a further aspect of the invention, there is provided a method for a person to stabilize his posture comprising the steps of:

a) providing a seating device comprising a seat connected to a stem, the stem being adapted to pivot between a first position whereat the stem is in a substantially vertical position, and a second position whereat the stem is forwardly inclined of 30 degrees or less with respect to the first position;

b) inserting a end portion of the stem into an aperture defined within a floor so as to stabilize the seating device; and c) sitting on the seat and selecting at least one position by inclining the stem, thereby providing a further point of support.

Applicants have found that by using such a method, a user is allowed to safely stabilize his posture thereby reducing the stress exerted on his legs. In particular, the method permits to reduce the stress exerted on the knees, ankles and feet of the user. This method also provides a safe and efficient solution for persons who perform tasks in both raised and sited positions to stabilize their posture. Such a method can also be applied by using any one of the seating devices described in the present invention.

The expression "substantially vertical position" as used herein refers to a position which can which extends at about 85 to about 95 degrees with respect to the ground or floor. Preferably, such a position extends at about 87 to about 93 degrees and more preferably at about 89 to about 91 degrees with respect to the ground or floor.

The term "floor" as used herein refers to the floor of a building or a vehicle.

The seating devices of the invention are preferably used on a floor being substantially flat. These devices are preferably stools and more preferably sit-stand stools. The seat and the supporting element are preferably coupled together so as to prevent rotation of the seat with respect to the supporting element. The end portion is preferably allowed to rotate freely within the aperture or bore according to an axis defined by the connecting element or the first member, respectively. The end portion preferably has a frusto-conical shape so as to facilitate its rotation within the aperture or bore. Preferably, the aperture or bore also has a frusto-conical shape.

When a seating device comprises a supporting element and a connecting element, a shaft can be connected to the connecting element and the supporting element can be rotatably mounted on the shaft. Preferably, the shaft is fixed to the connecting element and it comprises a threaded bolt provided with a nut. Alternatively, the supporting element and the connecting element can be pivotally connected together by means of a pivoting element. The pivoting element can be a shaft connected to the connecting element, the supporting element being mounted on the pivoting shaft. Preferably, the connecting element comprises a stop abutting a first portion of the supporting element at the first position, and abutting a second portion of the supporting element at the second position. A bias element can also be attached to the connecting element and to the supporting element so as to urge the supporting element in the first position. The seat preferably has a bottom surface or portion and the seat is preferably connected to one end of the supporting element, at the bottom surface or portion. The supporting element is preferably pivotally connected, at the other end, to the connecting element. The supporting element preferably comprises a rod connected to the seat, the rod being adjustably inserted in a stem so as to modify the length of the supporting element or the height of the seat with respect to the floor, and the stem being pivotally connected to the connecting element. Preferably, the supporting element comprises a pneumatic device so as to modify the length of the supporting element or the height of the seat with respect to the floor. In the second position, the supporting element is preferably inclined of 25 degrees or less, and more preferably of 20 degrees or less, with respect to the first position.

When a seating device comprises a supporting element having a first and a second member, the latter two members are preferably pivotally connected together by a shaft which is connected to the second member. The first member is pivotally mounted on the shaft. Preferably, the shaft is fixed to the second member and it comprises a threaded bolt provided with a nut. Alternatively, the first and second members can be pivotally connected together by means of a pivoting element. The pivoting element can be a shaft connected to the second member, the first member being mounted on the pivoting shaft. Preferably, at least one of the first and second members comprises a stop abutting a first portion of the supporting element at the first position, and abutting a second portion of the supporting element at the second position. A bias element can also be attached to the first and second members so as to urge the first member in the first position. The seat preferably has a bottom surface or portion and the seat is preferably connected to one end of the first member, at the bottom surface or portion. The first member is preferably pivotally connected, at the other end, to the second member. The first member preferably comprises a rod connected to the seat, the rod being adjustably inserted in a stem so as to modify the length of the supporting element or the height of the seat with respect to the floor, and the stem being pivotally connected to the connecting element. Preferably, the first member comprises a pneumatic device so as to modify the length of the supporting element or the height of the seat with respect to the floor. In the second position, the first member is preferably inclined of 25 degrees or less, and more preferably of 20 degrees or less, with respect to the first position.

When a seating device also comprises a receiving element, the latter preferably includes a first portion defining the internal bore. This first portion is adapted to be inserted in an aperture defined within the floor. The receiving element also includes a second portion connected to the first portion, the second portion being secured to the floor. The second portion is preferably dimensioned in order to avoid generating obstruction to a user's foot. The second portion can extend above the floor from less than 1 cm, and preferably form less than 0.30 cm.

The seating devices of the invention can further comprise an adjustment element for holding the supporting element in a selected inclined position so as to permit to a user to maintain the selected position without contacting the seating device. Advantageously, the seating devices comprise an adjustment element for modifying the tilt of the seat. The seat can also comprise a top surface having a periphery and a raised portion adjacent to the periphery. The raised portion is adapted to be grasped by at least one of the buttock muscles and ischial tuberosities of a user. Such a raised portion thus permits to reduce risks of sliding. It can also permit to the user to sit on the seat without use of his hands. The seating devices of the invention advantageously have a predetermined size so that they can be stored on a shelf below the top surface of a counter such as check-out counter as found in supermarkets or any retail stores. The seating devices of the invention can also comprise a footstool having an inclined surface for receiving user's feet, the surface being inclined in such a manner that a user's feet are upwardly extending. The footstool is advantageously disposed in proximity with the aperture or bore.

The preferred embodiments described above in respect of the seating devices according to the invention can also be applied to the method of the invention.

BRIEF DESCRIPTION OF THE DRAWINGS

Further features and advantages of the invention will become more readily apparent from the following description of preferred embodiments as illustrated by way of examples in the appended drawings wherein.

DESCRIPTION OF PREFERRED EMBODIMENTS

Figure 1:
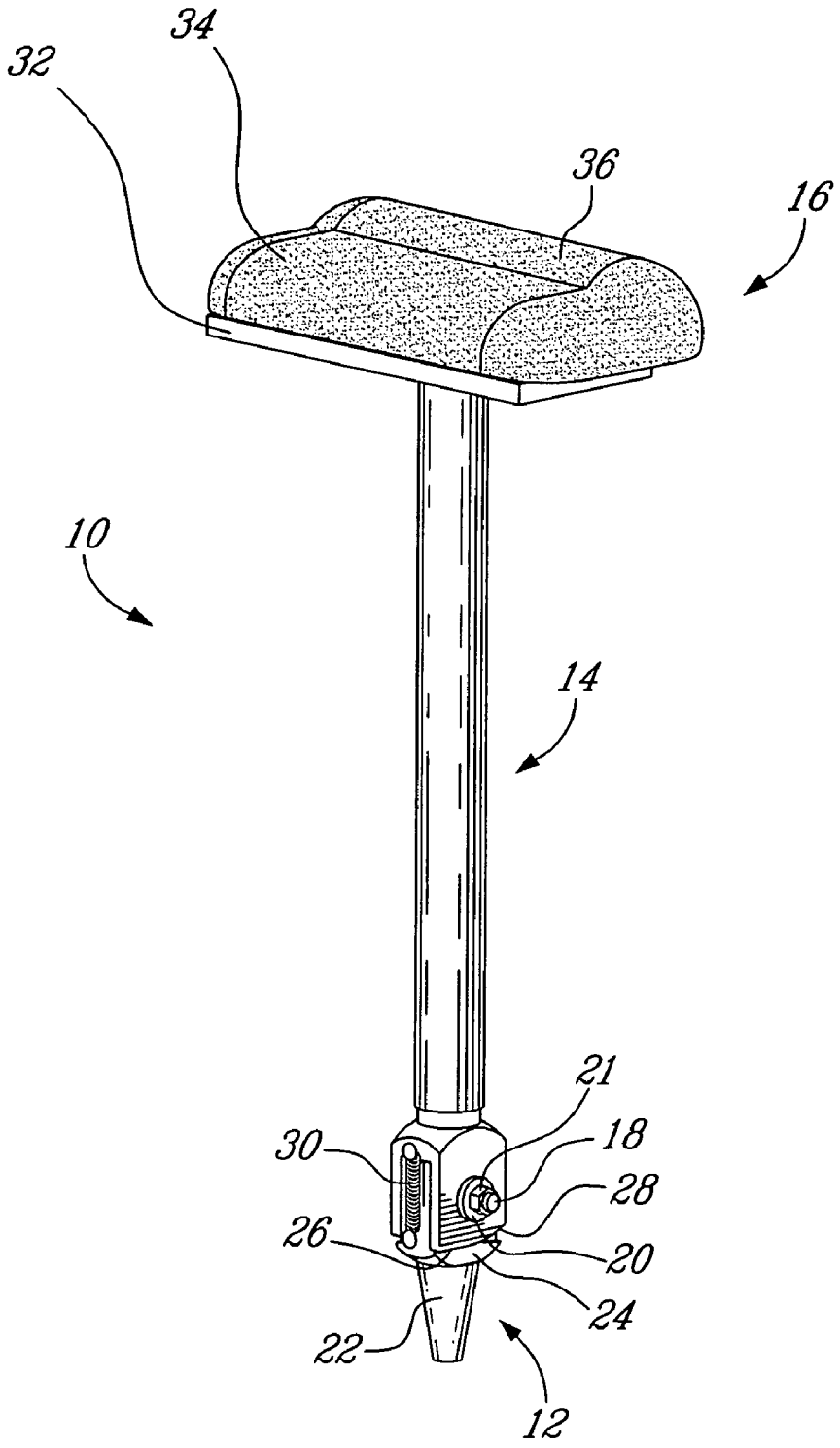
FIG. 1 is a rear perspective view of a seating device according to a preferred embodiment of the invention.
Figure 2:
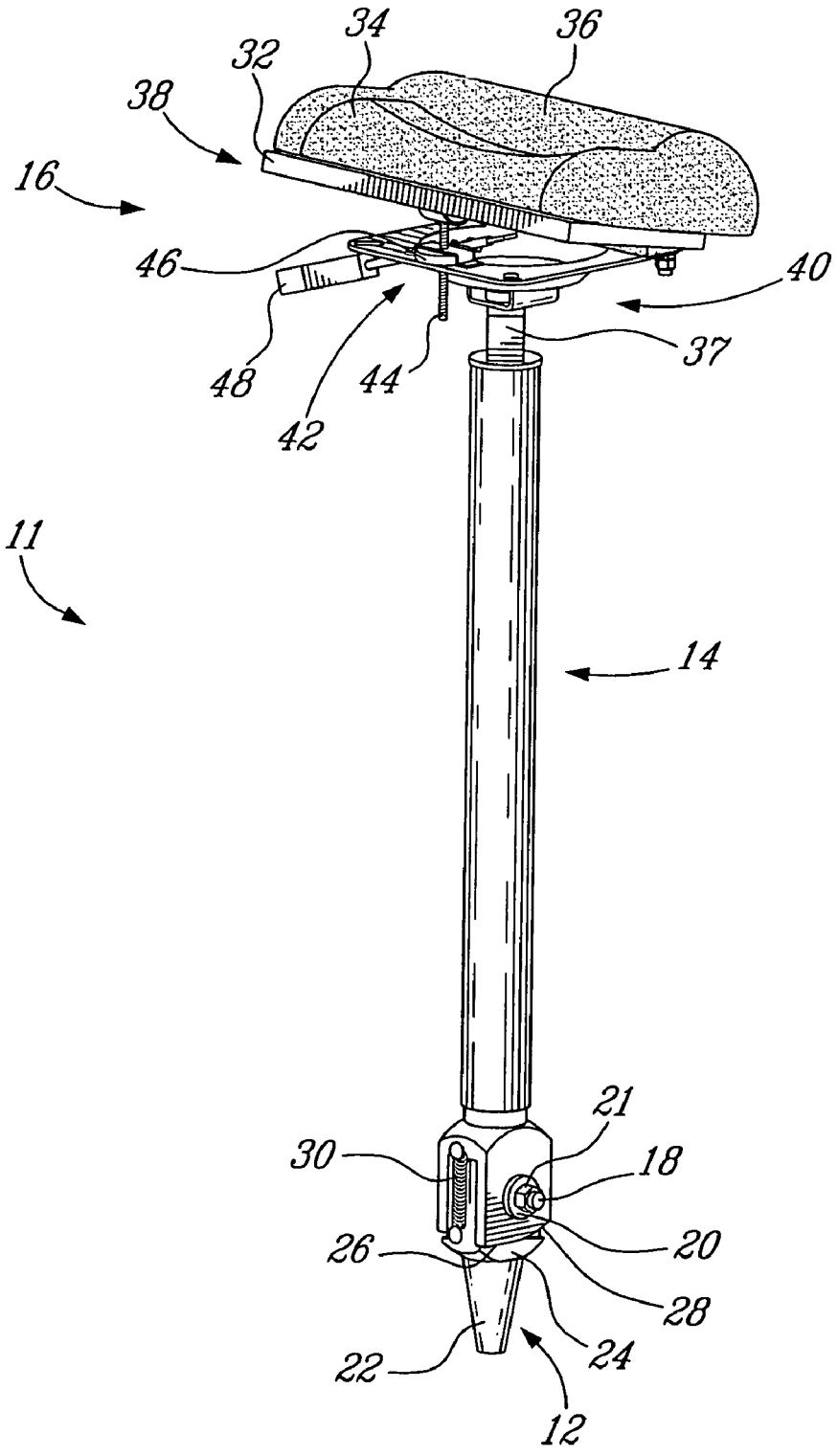
FIG. 2 is a rear perspective view of a seating device according to another preferred embodiment of the invention.

Referring first to FIGS. 1 and 2, there is shown a seating device 10 or 11 comprising a connecting element 12, a supporting element 14 and a seat 16. Seating devices 10 and 11 are similar, with the exception that the seating device 11 further comprises few adjustment elements. The connecting element 12 is pivotally connected to the supporting element 14. In fact, the supporting element 14 is mounted on a bolt 18 provided with a washer 20 and a nut 21. The connecting element 12 and the supporting element 14 both define apertures through which the bolt 18 is inserted and then inserted in the washer 20 and the nut 21, thereby pivotally connecting the latter two elements. The supporting element 14 and the connecting element 12 can also be pivotally connected by several other manners such as a shaft provided with rivets, a hinge or any means known to the person skilled in the art so as to pivotally connect the two elements together.

Figure 3:
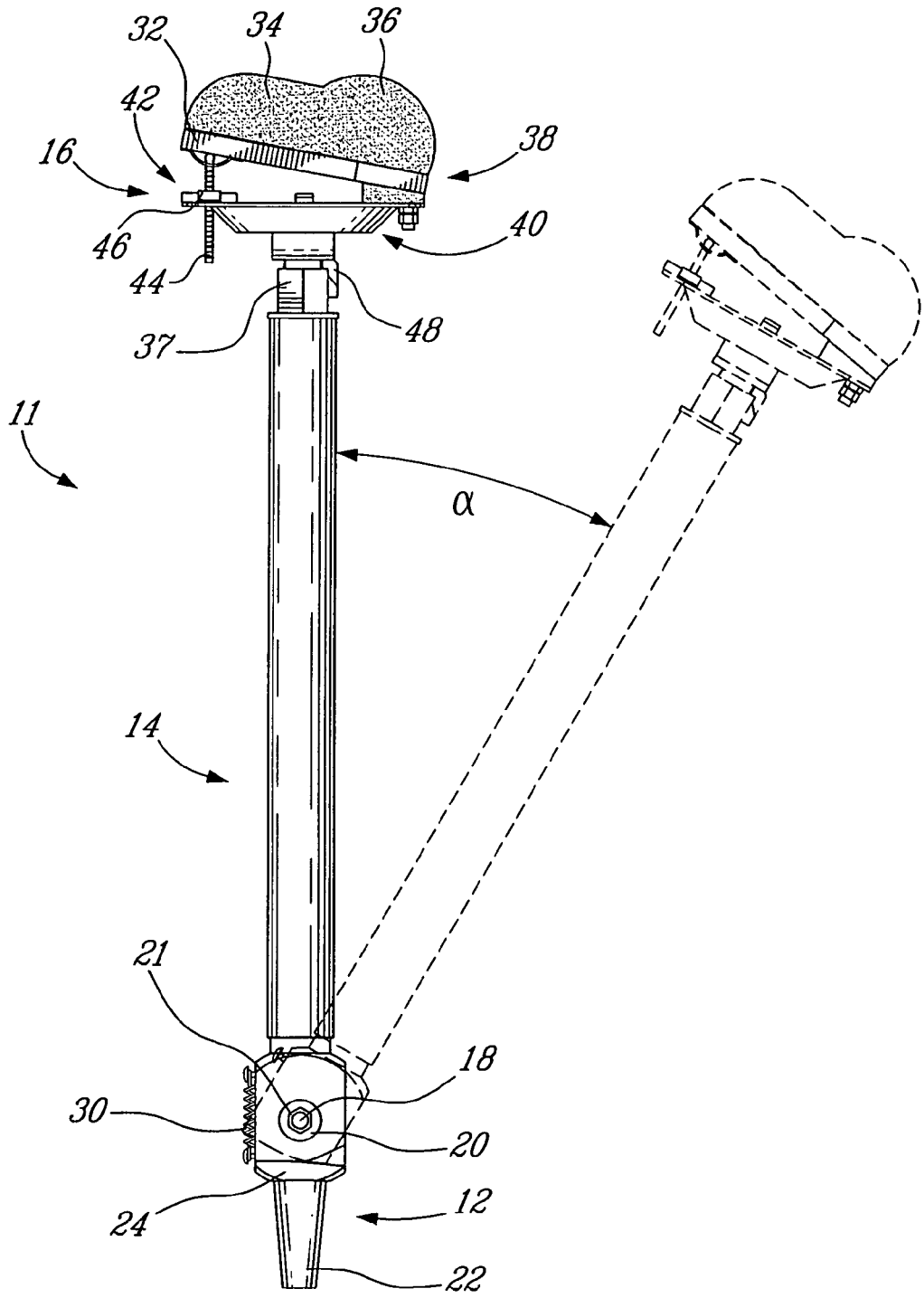
FIG. 3 is a side elevation view of the seating device shown in FIG. 2, wherein different positions of the seating device are shown.
Figure 4:
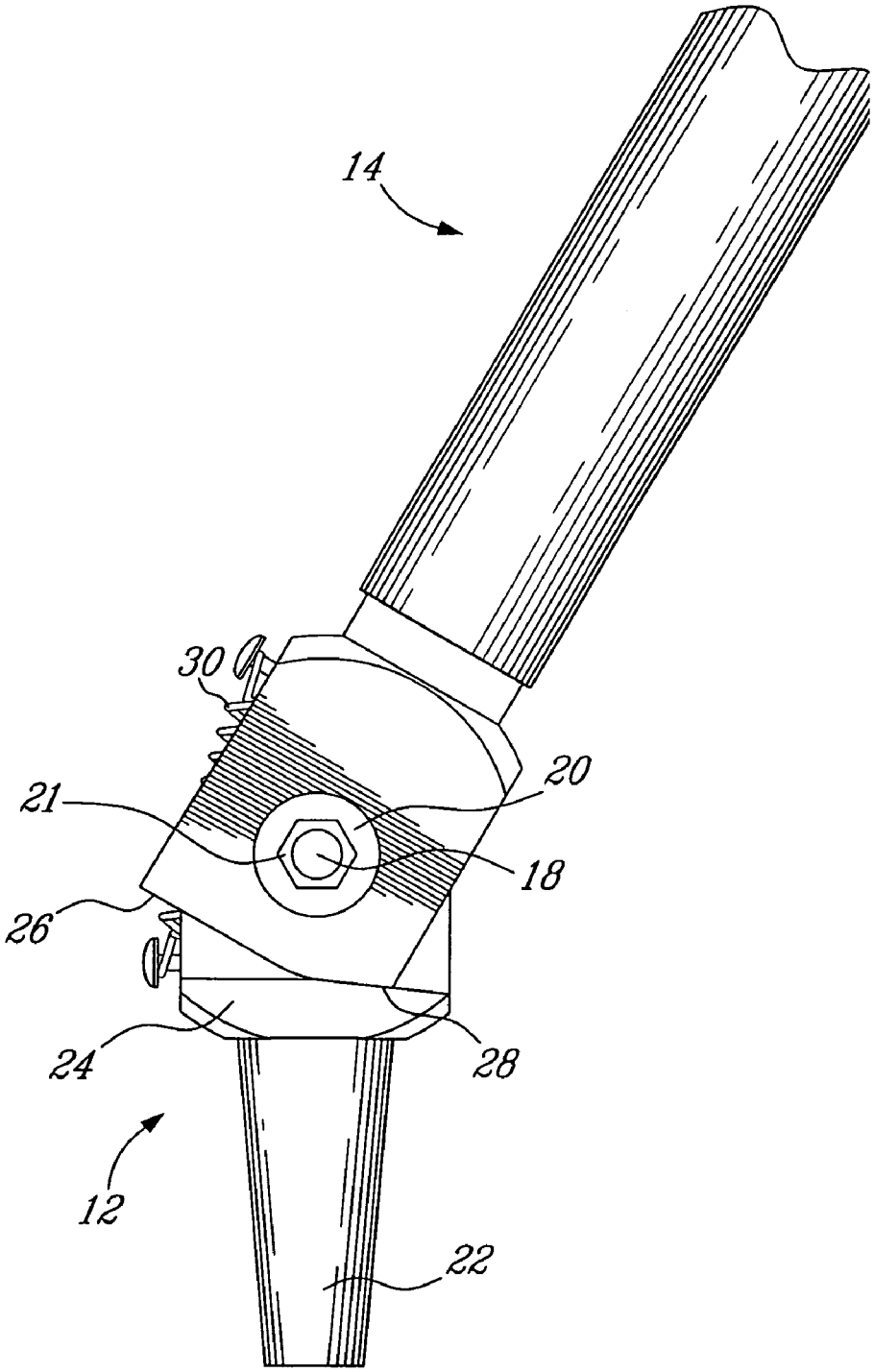
FIG. 4 is a side elevation view, partly fragmented, of the seating device shown in FIG. 3, wherein the seating device is shown in an inclined position.
Figure 5:
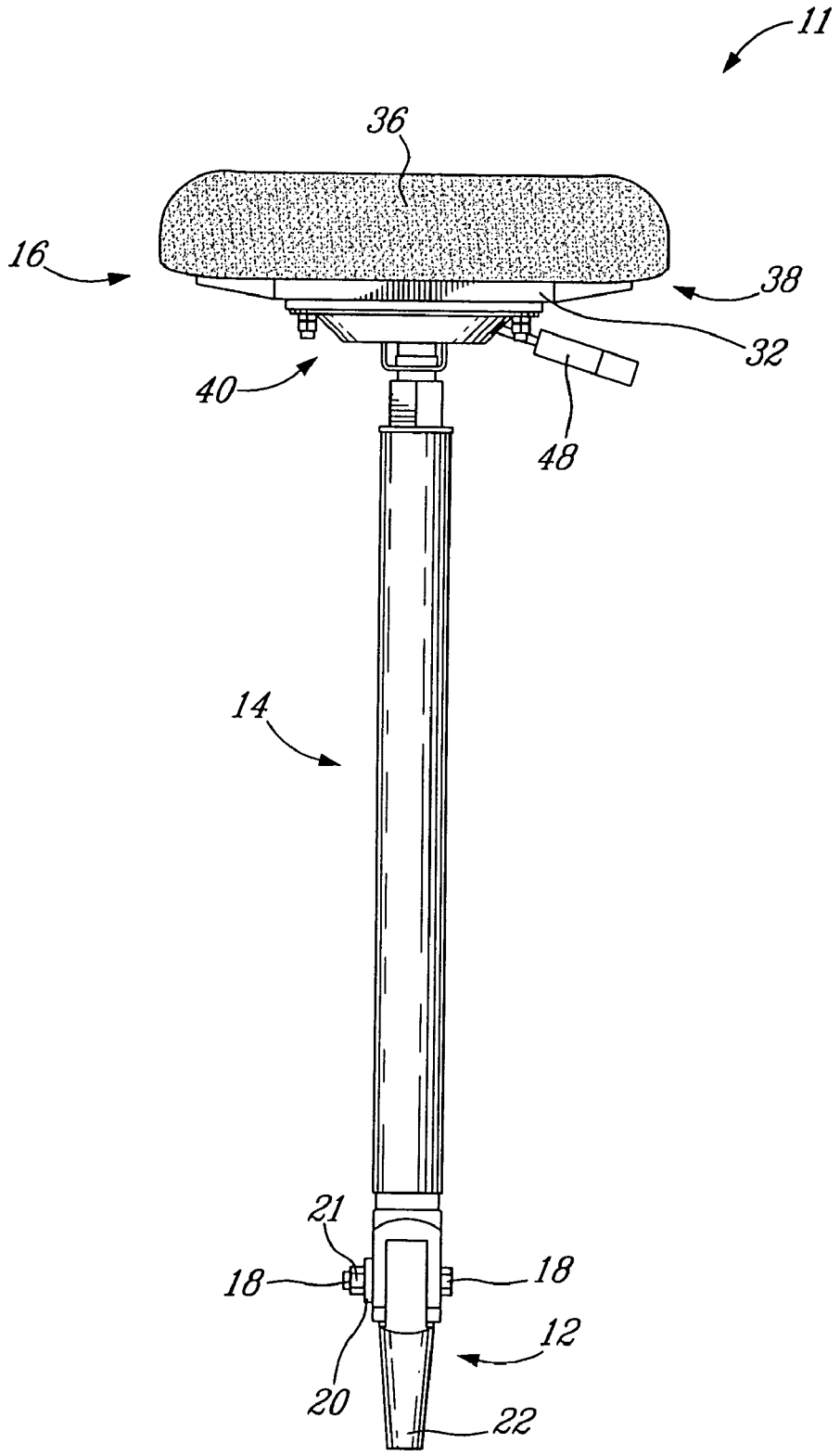
FIG. 5 is a rear elevation view of the device shown in FIG. 2.

The connecting element 12 has an end portion 22 having a frusto-conical shape and which is adapted to be inserted in an aperture defined in a floor so as to support the seating device 10 or 11. The connecting element 12 also comprises a stop 24 which abuts a first portion 26 of the supporting element 14 in a raised or first position and a second portion 28 of the supporting element 14 in an inclined or second position (FIGS. 1 to 4). The stop 24 thus permits the supporting element 14 to pivot between a first position where it extends substantially vertically and a second position where it is inclined according to the angle α (FIG. 3). The angle α has a value of about 30 degrees or less, preferably about 25 degrees or less and more preferably about 20 degrees or less. The stop 24 thus prevents the supporting element 14 from being tilted or inclined rearwardly beyond a substantially vertical position, and forwardly beyond the second position. Alternatively, a stop can be disposed on said supporting element as it can be seen from FIG. 4, both portion 28 and stop 24 comprise a recessed or rounded portion so as to permit the supporting element 14 to be forwardly inclined. The connecting element 12 and the supporting element 14 are also connected together by a bias element such as a bias spring 30 which urges the supporting element 14 in the raised or first position.

Thus, when a user is sitting on the seating device 10 or 111 stands up and leaves his sitting position, the supporting element 14 will automatically pivot from an inclined position to the raised or first position. Optionally, the nut 21 can be adjusted in such a manner to increase the friction between element 12 and 14 so that the spring 30 will not be sufficient to urge the inclined supporting element 14 in the first portion. Thus, such an adjustment will permit to the user to maintain a selected inclined position even without holding or contacting the device. Such an option can be particularly useful if the user quits his sitting position for few moments and he then wants to quickly adopt again the same sitting position without being obligated to adjust the device one more time so as to select this particular position. From these explanations, it will be understood by the person skilled in the art that other adjustment elements can be provided in replacement of the nut 21, and which will be more easily adjusted by the user.

As shown in FIG. 1, the seat 16 comprises a seat panel 32 secured to the supporting element 14, and a seating portion 34. The seating portion 34 preferably comprises a cushion. The seating portion 34 further comprises a lip or raised portion 36 which permits the user to easily grab the seat with his buttocks muscles and/or with his ischial tuberosities without using his hands. Moreover, such a raised portion reduces the risks for the user to loose grip and slide when contacting the seating portion with his muscles and/or ischial tuberosities.

As shown in FIGS. 2, 3 and 5 to 7, the seat 16 can be connected to the supporting element 14 by means of a coupling element 37 having a parallelepiped shape so as to prevent the rotation of the seat 16 with respect to the supporting element 14. The seat 16 can further comprises adjustment devices. A top portion 38 including the seating portion 34 having a lip 36 and the seat panel 32 is connected to a bottom portion 40 by means of an adjustment element 42. The seat panel 32 is connected to the bottom portion 38 by means of the adjustment element 42 which comprises a threaded rod 44 inserted in a screw nut 46. The top portion 38 can thus be inclined with respect to the bottom portion 42 by adjusting the screw nut 46. It has been found that by using such an adjustment element, it is possible to limit the space required for the operating radius of the device in view of the tilt of the seat 16. The seating device 11 also comprises an actuating lever 48 coupled with a pneumatic device such as a pneumatic compression spring assembly i.e. a telescoping cylinder-piston assembly (not shown) which permits to adjust the length of the supporting element 14 (or the height of the seat 16 with respect to the floor). The pneumatic device can be as example a pneumatic compression spring assembly is one as usually used in the manufacture of chair or the like and it comprises a slidable piston attached to a piston rod which is inserted in the supported member 14 acting as a housing.

Alternatively, the supporting element can comprises a rod connected to the seat and slidably inserted in a housing comprising a clamping device so as to adjust the length of the supporting element. Such an adjustable supporting element is described in U.S. Pat. No. 4,130,263, which is hereby incorporated by reference. Moreover, the supporting element can comprise a housing having an interior threaded section in which a spindle is inserted, the spindle being connected to the seat. Such an adjustable supporting element is described in U.S. Pat. No. 6,644,742, which is hereby incorporated by reference.

Figure 6:
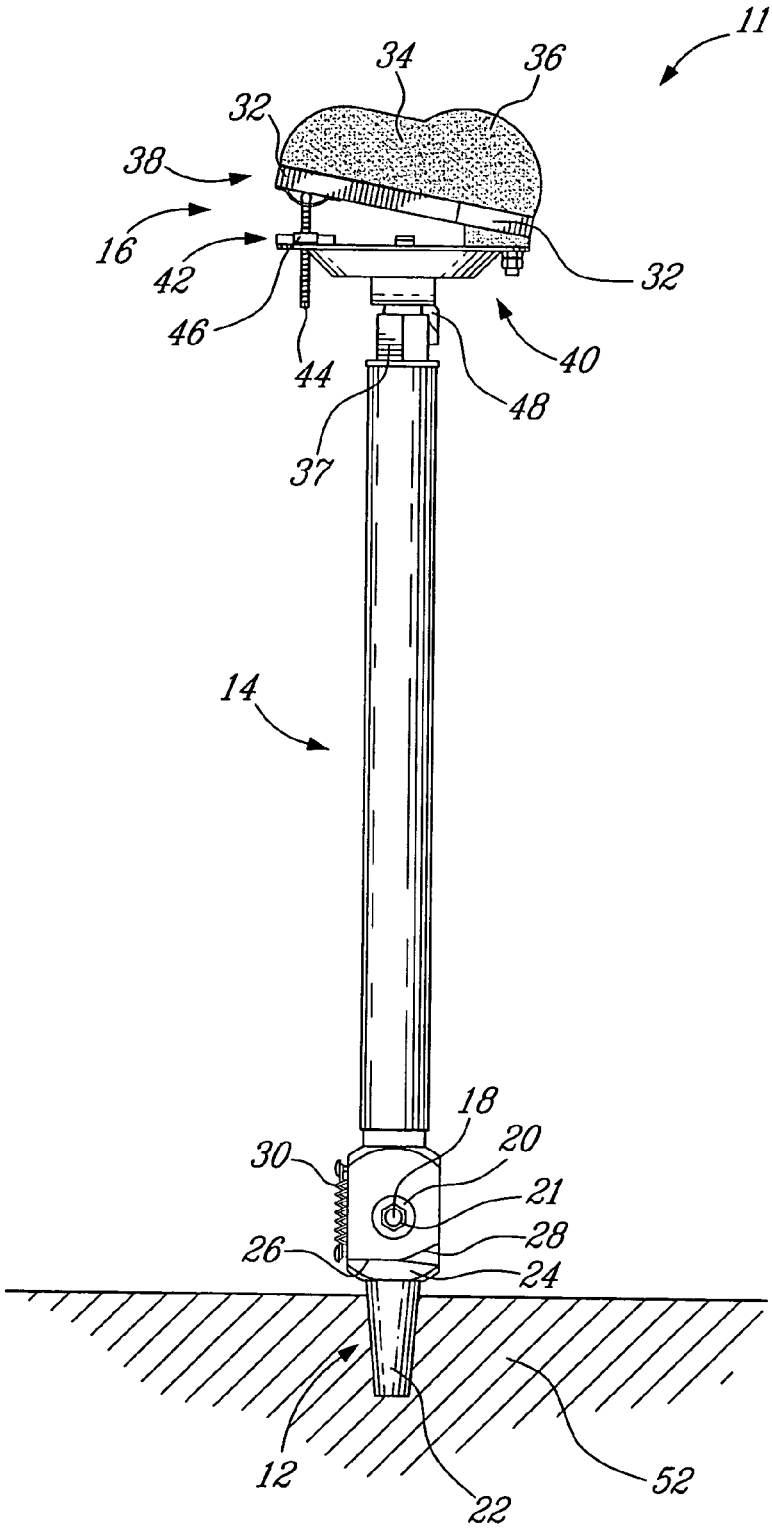
FIG. 6 is a side elevation view of the seating device shown in FIG. 2, wherein the seating device is inserted in an aperture defined in a floor.

FIG. 6 shows the seating device 11 which has been inserted in an aperture defined in a floor 52, the aperture being dimensioned to receive the connecting element 12. The floor 52 is preferably a floor comprising a resistant material such a metal or concrete.

Figure 7:
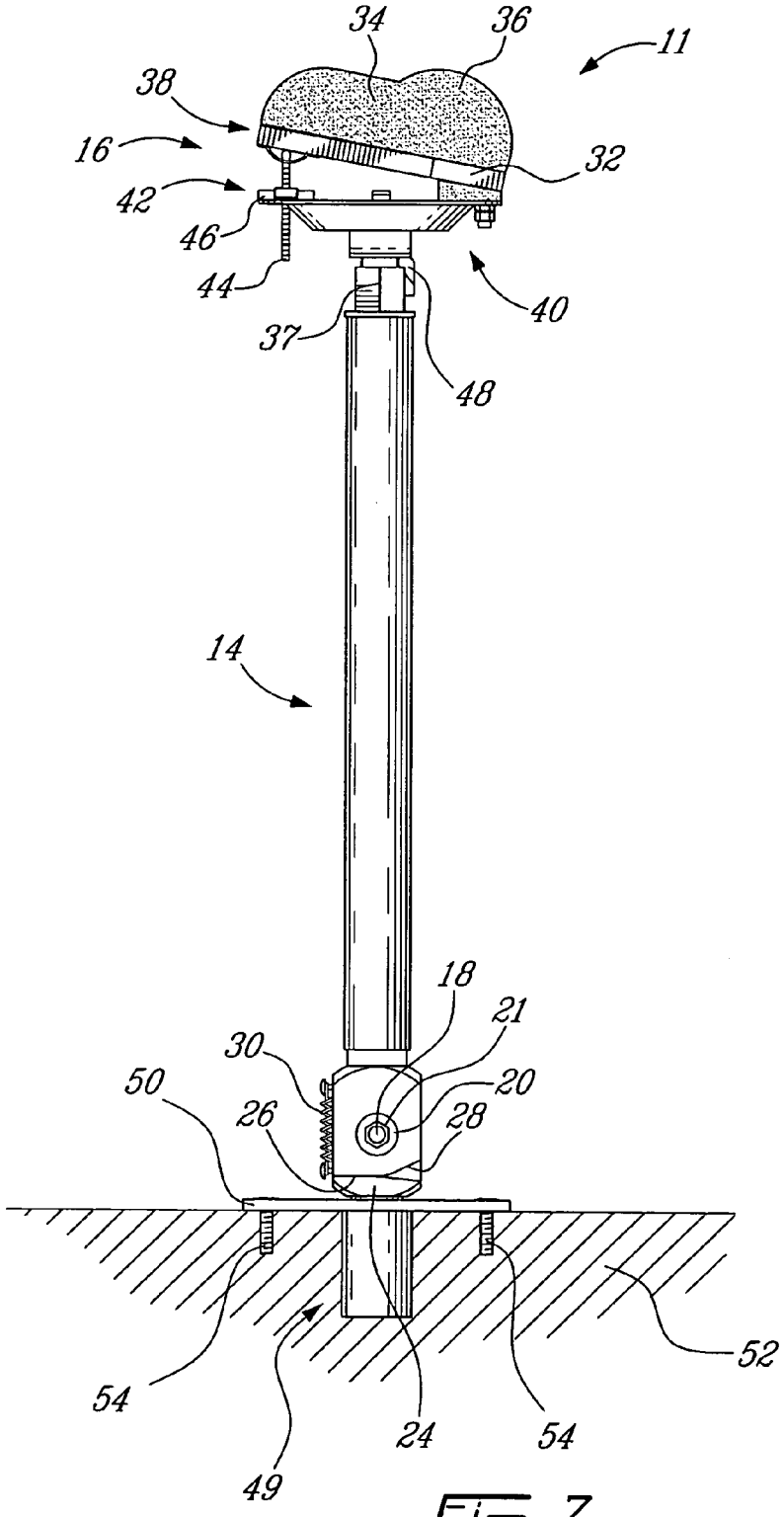
FIG. 7 is a side elevation view of the seating device shown in FIG. 2, wherein the seating device is inserted in a receiving element according to another preferred embodiment of the invention.

FIG. 7 shows the seating device 11 inserted in a receiving element 49 comprising an internal bore (not shown) adapted to receive the portion 22 of the connecting element 12. The internal bore can also be provided with Teflon® so as to facilitate rotation of the portion 22, thereby reducing friction. The receiving element 49 also has a flat portion 50 contacting the floor 52. The flat portion 50 defines apertures (not shown) in which fasteners 54 such as screws or bolts are inserted so as to secure the receiving element 50 to the floor. Such a flat portion and fasteners are preferably as thin as possible so as to prevent generating obstruction to a user's foot. Thus, when the device is stored, the presence of the receiving element 49 does not cause any inconvenience to a person walking on the floor. Optionally, the hole defined by the internal bore can be covered by a cap when the device is not inserted therein.

Figure 8:
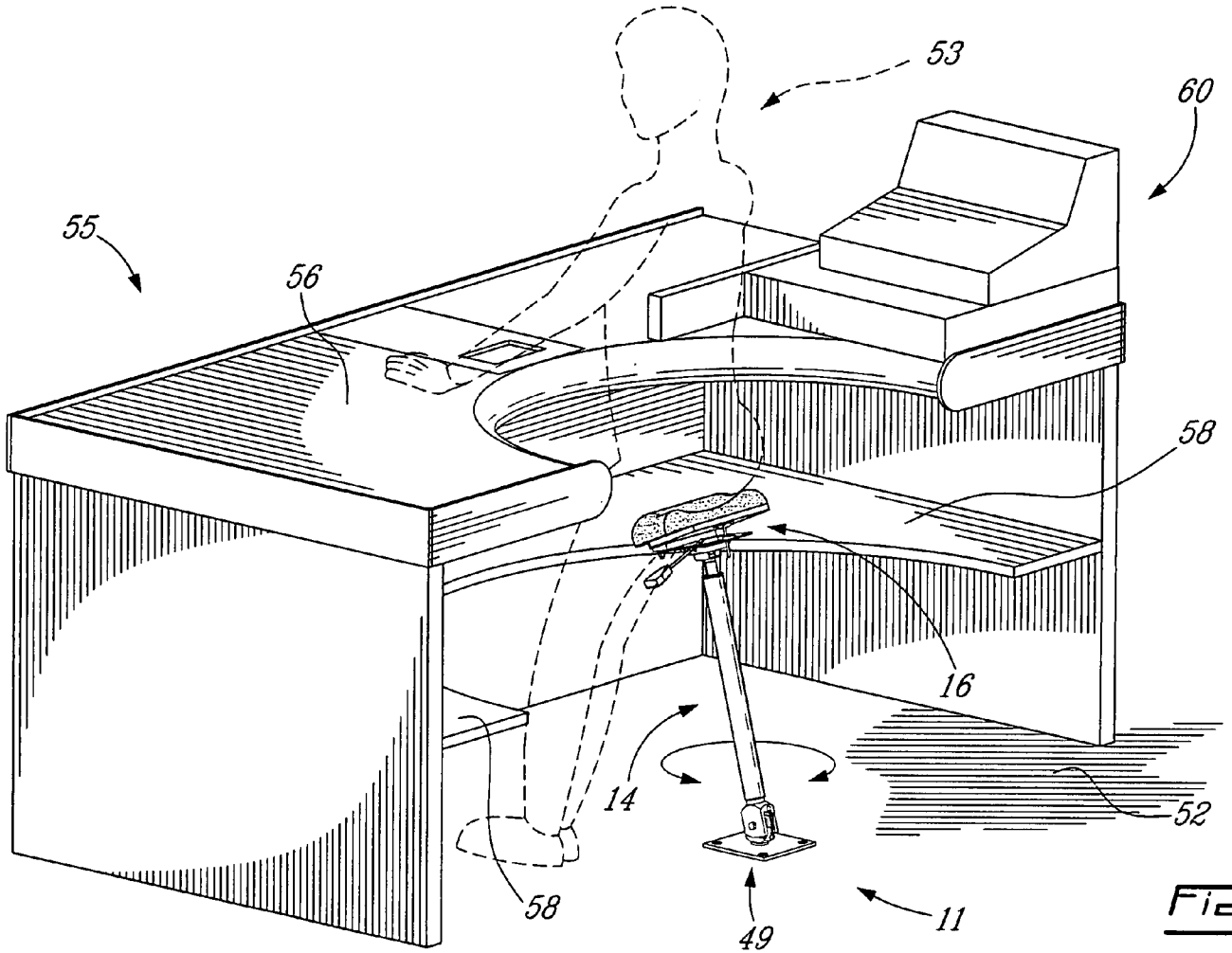
FIG. 8 is a rear perspective view of a seating device according to another preferred embodiment of the invention.
Figure 9:
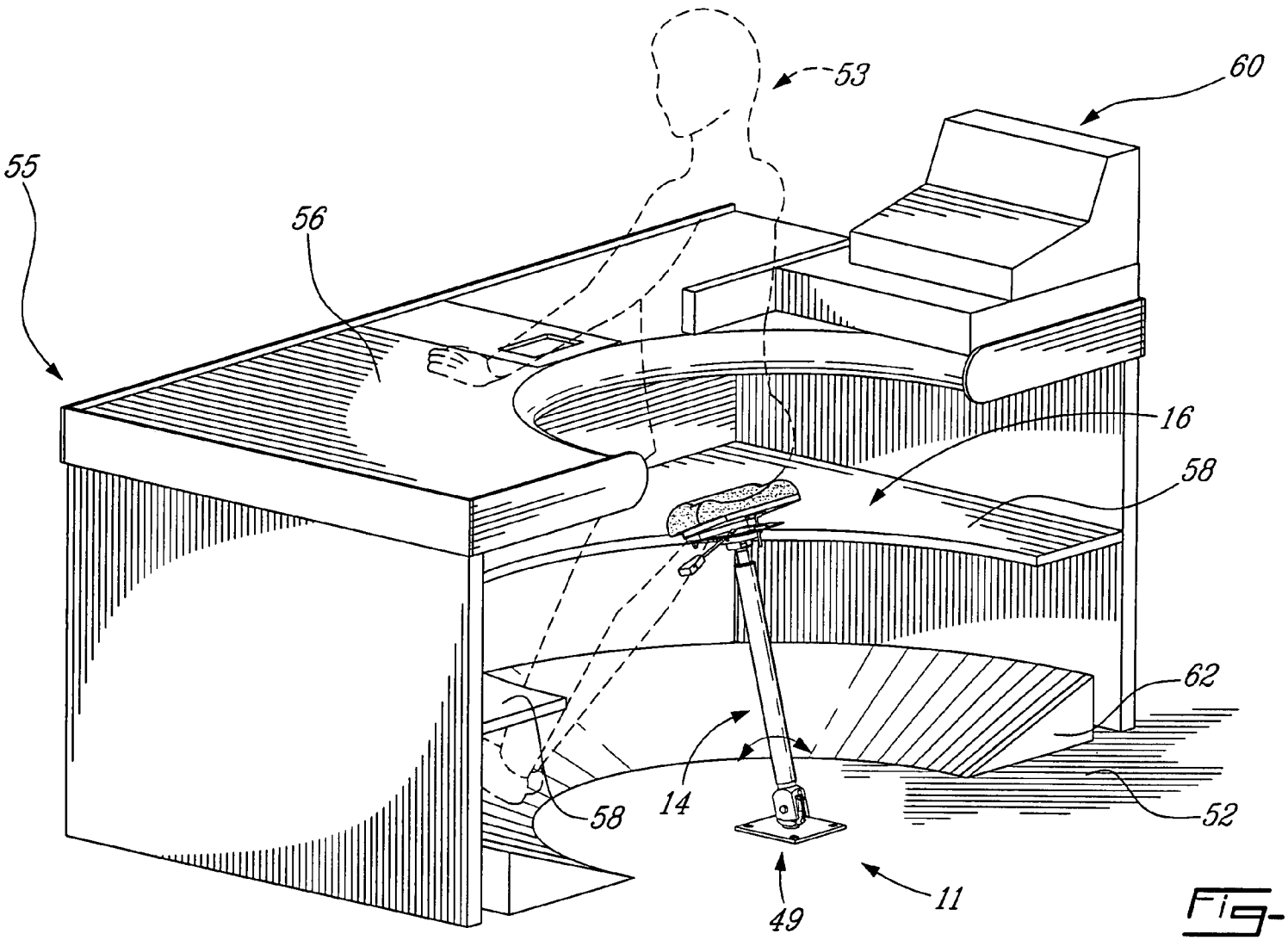
FIG. 9 is a rear perspective view of a seating device according to another preferred embodiment of the invention.
Figure 10:
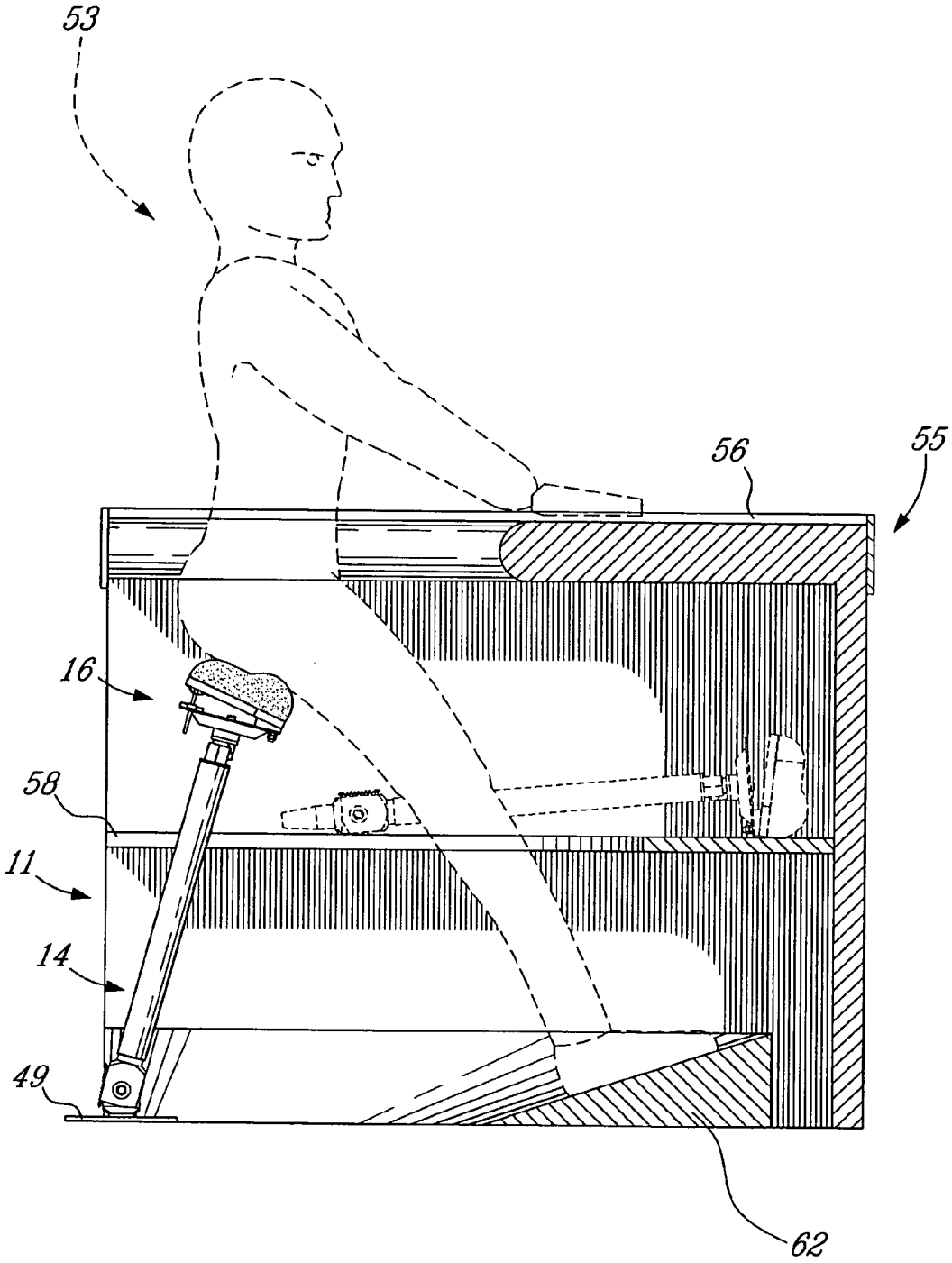
FIG. 10 is a side elevation view of a seating device shown in FIG. 9, wherein the device is also shown as stored on a shelf.

As shown in FIGS. 8 to 10 the seating devices of the present invention can be particularly useful for a person 53 working as a cashier for example. Usually such workers perform tasks which necessitate a certain mobility. In particular, these persons manipulates purchased articles on a check-out counter 55 having a top surface 56 and a shelf 58, as well as perform tasks with a cash register 60. Over extended period of times such tasks requiring several displacements can be very tiring since the persons usually stands up. When using one of the devices of the present invention the user can thus stabilize his posture has shown in FIGS. 8 to 10 while maintaining a good mobility since these devices can be rotated and forwardly inclined.

As shown in FIG. 10, the seating device 11 is not bulky and can easily be stored on the shelf 58. Preferably, the seating device 11 has a weight of 3.75 kg or less and more preferably of 2.25 kg or less. When the person wants to use the device, the latter just needs take it from the shelf 58 and insert the end portion 22 (FIGS. 2 to 4)-into the bore defined in the receiving element 49 (FIGS. 7 to 10) so as to support the seating device 11. Then, the person can grab the raised portion 36 (FIGS. 2 and 3) with his buttock muscles and/or ischial tuberosities so as to sit on the seat 16. Before or while sitting on the seat 16, the person can adjust the tilt of the seat 16 with the adjustment element 42. The person can also adjust the height of the seat 16 with respect to the floor 52, by means of the lever 48.

The person thus sitting or being supported by the device in a sit-stand position can rotate the latter or tilt it so as to perform his tasks. If the person quits the device, the spring 30 (FIGS. 3 and 4) will urge the seating device in the first position. Optionally, the nut 21 (FIGS. 1 to 4) can be adjusted so as to hold the device in a particular inclined position. When the person wants to store the seating device 11, the latter simply has to remove the device from the receiving element 49 and store it on the shelf 58.

As shown in FIG. 8, the person 53 adopting a sit-stand position is provided with supplemental point of supports since he is sitting on the seating device 11 and his hands are abutting the top surface 56. For extra stability and comfort, the device of the invention can be provided with a footstool 62 (FIGS. 9 and 10) having an inclined surface so as to permit to the person 53 to reduce the stress exerted on his feet, knees and ankles. The slope of the footstool 62 is preferably of about 15 to about 25 and preferably about 20 degrees. The top surface of the footstool 62 can be advantageously provided with a non-slip material like a polymeric material or a rubber-like material.

The seating device and method of the present invention can be used by different workers in different job environments. As examples they can be used by cashiers and clerks in retail stores, supermarkets and banks. They can also be used by persons working in laboratories or workers in a plant. The seating device and method of the present invention can be used for practicing various types of hobbies such as fishing and hunting. As example, such a device can be inserted in the floor of a boat thereby providing a supplemental point of support to a fisher while permitting him to have a good mobility. The device can also be used as an alternative to the traditional stools used by musicians such as guitar players. It can further be used by percussionists.

While the invention has been described with particular reference to the illustrated embodiment, it will be understood that numerous modifications thereto will appear to those skilled in the art. Accordingly, the above description and accompanying drawings should be taken as illustrative of the invention and not in a limiting sense.

What is claimed is:

1. A seating device comprising:

a connecting element having a end portion dimensioned to be releasably and rotatably inserted into an aperture defined in a ground or a floor, said aperture being dimensioned to receive said connecting element so as to support said seating device; and a supporting element connected to a seat, said supporting element being pivotably connected to said connecting element, at least one of said connecting element and supporting element comprises at least one stop so as to permit said supporting element to pivot between a first position whereat said supporting element is in a substantially vertical position and a second position whereat said supporting element is forwardly inclined of 30 degrees or less with respect to said first position.

2. The seating device of claim 1, wherein said aperture is defined in a floor.

3. The seating device of claim 1, wherein said seat and said supporting element are coupled together, thereby preventing rotation of said seat with respect to said supporting element.

4. The seating device of claim 1, wherein said end portion of said connecting element is allowed to rotate freely within said aperture according to an axis defined by said connecting element.

5. The seating device of claim 1, wherein said end portion of said connecting element and said aperture have a frusto-conical shape.

6. The seating device of claim 1, wherein a shaft is connected to said connecting element and said supporting element is pivotally mounted on said shaft.

7. The seating device of claim 1, wherein said connecting element comprises a stop abutting a first portion of said supporting element at said first position, and abutting a second portion of said supporting element at said second position.

8. The seating device of claim 1, further comprising an adjustment element which permits to hold said supporting element in a selected inclined position.

9. The seating device of claim 1, further comprising a bias element attached to said connecting element and to said supporting element so as to urge said supporting element in said first position.

10. The seating device of claim 1, wherein said seat has a bottom surface, said seat being connected to one end of said supporting element, at said bottom surface.

11. The seating device of claim 10, wherein said supporting element is pivotally connected, at another end, to said connecting element.

12. The seating device of claim 1, wherein said supporting element comprises a rod connected to said seat, said rod being adjustably inserted in a stem so as to modify the length of said supporting element, and said stem being pivotally connected to said connecting element.

13. The seating device of claim 1, wherein said supporting element further comprises a pneumatic device permitting to modify the length of the supporting element.

14. The seating device of claim 1, further comprising an adjustment element for modifying tilt of said seat.

15. The seating device of claim 1, wherein said seat comprises a top surface having a periphery and a raised portion adjacent to said periphery, said raised portion being adapted to be grasped by at least one of buttock muscles and ischial tuberosities of a user, thereby permitting to reduce risks of sliding.

16. The seating device of claim 1, wherein said device has a predetermined size so that said seating device is storable on a shelf below a top surface of a check-out counter.

17. The seating device of claim 1, wherein in the second position, said supporting element is forwardly inclined of 25 degrees or less with respect to said first position.

18. The seating device of claim 1, wherein in the second position, said supporting element is forwardly inclined of 20 degrees or less with respect to said first position.

19. A seating device comprising:

a receiving element adapted to be fixed to a floor, said receiving element defining an internal bore;

a connecting element having a end portion dimensioned to be releasably and rotatably inserted into a said bore so as to support said seating device; and a supporting element connected to a seat, said supporting element being pivotably connected to said connecting element, at least one of said connecting element and supporting element comprises at least one stop so as to permit said supporting element to pivot between a first position whereat said supporting element is in a substantially vertical position and a second position whereat said supporting element is forwardly inclined of 30 degrees or less with respect to said first position.

20. The device of claim 19, further comprising a footstool having an inclined surface adapted to receive user's feet in an upwardly extending manner.

21. The seating device of claim 19, wherein said receiving element comprises:

a first portion defining said internal bore, said first portion being adapted to be inserted in an aperture defined within said floor; and a second portion connected to said first portion, said second portion being adapted to be secured to said floor.

22. The seating device of claim 21, wherein said second portion is adapted to avoid generating obstruction to a user's foot.

23. The seating device of claim 21, wherein said second portion is adapted to extend above said floor from less than 1 cm.

24. The seating device of claim 23, wherein said second portion is adapted to extend above said floor from less than 0.30 cm.

25. A seating device comprising:

a seat; and a supporting element having a first member connected to said seat, and a second member having an end portion dimensioned to be releasably and rotatably inserted into a floor defining an aperture dimensioned to receive said end portion so as to stabilize said second member within said aperture, said first and second member being pivotally connected together and said supporting element comprising at least one stop so that said first member is allowed to pivot between a first position whereat said first member is in a substantially vertical position, and a second position whereat said first member is forwardly inclined of 30 degrees or less with respect to said first position.

26. The seating device of claim 25, wherein said seat has a bottom surface connected to one end of said first member, said first member being pivotally connected, at another end, to said second member.

27. The seating device of claim 25, wherein said seat and said first member are coupled together, thereby preventing rotation of said seat with respect to said first member.

28. The seating device of claim 25, wherein first and second members are pivotally connected together by shaft connected to said second member, said first member being pivotally mounted on said shaft.

29. The seating device of claim 25, wherein at least one of said first and second members comprises at least one stop.

30. The seating device of claim 25, wherein said second member comprises a stop abutting a first portion of said first member at said first position, and abutting a second portion of said first member at said second position.

31. A method for a person to stabilize his posture comprising the steps of:

a) providing a seating device comprising a seat connected to a stem, said stem being adapted to pivot between a first position whereat said stem is in a substantially vertical position, and a second position whereat said stem is forwardly inclined of 30 degrees or less with respect to said first position;

b) inserting a end portion of said stem into an aperture defined within a floor so as to stabilize said seating device; and c) sitting on said seat and selecting at least one position by inclining said stem, thereby providing a further point of support.

32. The method of claim 31, further comprising the step of abutting his feet against an inclined footstool disposed adjacently to said seating device so as to reduce stress exerted on his feet.

33. The method of claim 31, further comprising the step of abutting at least one hand or forearm, or the torso against a counter disposed adjacently to said seating device so as to provide a further point of support.

* * * * *